United States Patent [19]

Sawatari et al.

[11] Patent Number: 4,699,863

[45] Date of Patent: Oct. 13, 1987

[54] ELECTROPHOTOGRAPHIC FLASH FIXATION PROCESS EMPLOYING TONER HAVING IMPROVED LIGHT ABSORPTION PROPERTIES AND TONER THEREFOR

[75] Inventors: Norio Sawatari, Sagamihara; Yasuo Yamagishi, Zama; Katsuji Ebisu, Isehara; Yoshimichi Katagiri, Chigasaki; Toshiaki Narusawa, Sagamihara, all of Japan

[73] Assignee: Fujitsu Limited, Kawasaki, Japan

[21] Appl. No.: 800,334

[22] Filed: Nov. 21, 1985

[30] Foreign Application Priority Data

Dec. 3, 1984 [JP] Japan ..... 59-254170

[51] Int. Cl.[4] ..... G03G 13/20; G03G 9/08

[52] U.S. Cl. ..... 430/97; 430/109; 430/124

[58] Field of Search ..... 430/97, 124, 109; 427/148

[56] References Cited

U.S. PATENT DOCUMENTS 4,352,877 10/1982 Narusawa et al. ..... 430/97

4,425,161 1/1984 Shibahashi et al. ..... 427/150

*Primary Examiner*—John L. Goodrow

*Attorney, Agent, or Firm*—Staas & Halsey

[57] ABSTRACT

A flash fixing process characterized by using a powdery developing toner comprising at least 80% by weight of a bisphenol A/epichlorohydrin type epoxy resin or a polyester resin as the binder resin, 1 to 10% by weight of a dye or pigment as the colorant and 1 to 10% by weight of a specific aminium compound.

25 Claims, 3 Drawing Figures

ELECTROPHOTOGRAPHIC FLASH FIXATION PROCESS EMPLOYING TONER HAVING IMPROVED LIGHT ABSORPTION PROPERTIES AND TONER THEREFOR

BACKGROUND OF THE INVENTION (1) Field of the Invention

The present invention relates to a flash fixation process using a toner for visualizing an electrostatic latent image in electrophotography or the like.

(2) Description of the Related Art

In general, in the electrophotography processes used in copying machines or laser printers, an electrostatic charge is uniformly applied to a photoconductive insulator layer, the insulator layer is exposed imagewise to light to partially remove the electrostatic charge and form an electrostatic latent image thereon, a fine powder called "toner" is caused to adhere to the electrostatic charge-remaining area to visualize the latent image and form a toner image (this operation is called "development"), and the toner image is fixed to a recording paper to obtain a print (this operation is called "fixation").

The toner is a finely divided powder formed by dispersing a colorant and a charge control agent in a binder resin composed of a natural or synthetic polymeric substance and pulverizing the dispersion to a size of about 1 to about 30 μm. Ordinarily, this finely divided powder is mixed with a carrier such as iron powder or glass beads to form a developer, and such developer is used for the development. However, the above-mentioned toner image is composed solely of the toner.

The fixation is an operation of melting the toner of the toner image and fixing it to a recording paper. The known fixation methods include, heat-pressure fixation, oven fixation, pressure fixation, solvent fixation and light fixation. In flash fixation which is a typical example of light fixation processes, fixation is effected by a flash of a discharge tube such as a xenon flash lamp, and this flash fixation process is preferred because of the following characteristics.

(1) Since the fixation is a non-contact fixation, resolution in the developed image is not degraded by the fixation.

(2) There is no wait time after application of electric power, and quick starting is possible.

(3) Even if jamming of recording paper occurs in the fixing zone by system-down, ignition is not caused.

(4) Fixing is possible irrespective of the material and thickness of recording papers, and therefore, fixation can be made on pasted papers, preprinted papers, papers differing in thickness and the like.

However, only black toners have been used in flash fixation processes until the present. Since coloration is now advanced in office automation (OA) equipment, it is eagerly desired to provide color toners applicable for flash fixation processes as soon as possible.

The conventional process for fixing a toner 1 to a recording paper 2 by the flash fixation will now be described with reference to FIGS. 1*a* and 1*b*.

As pointed out hereinbefore, when a toner image is transferred onto the recording paper 2, the toner 1 adheres in the powdery state to the recording paper 2 to form an image as shown in FIG. 1*a*, but this image may be crumbled, for example, by rubbing with the fingers. If a flash 3 of a discharge tube such as a xenon flash lamp is applied to the toner image, the toner 1 absorbs the energy of the flash 3 to convert it to a thermal energy, and hence, the temperature is elevated and the toner is softened and melted and adheres to the recording paper 2. After the extinction of the flash 3, the temperature falls and a fixed image 4 is formed by solidification, as shown in FIG. 1*b*, whereby the fixation is completed. Now the fixed image 4 on the recording paper 2 may no longer be crumbled, for example, by rubbing with the fingers.

It is important that the toner 1 should be melted and adhered closely to the recording paper 2. Accordingly, it is necessary for the toner 1 to absorb a sufficient amount of light energy, including the thermal energy which will diffuse to the outside and make no contribution to the elevation of the temperature of the toner, from the flash 3.

As shown in FIG. 2, the spectral distribution of the flash from a xenon flash lamp ordinarily used as the discharge tube for flash fixation processes covers a broad area ranging from the ultraviolet region to the infrared region, but the spectral intensity of the flash is strong only in the near infrared region of 800 to 1000 nm and the spectral intensity of the flash is relatively weak in other regions including in the visible region of 400 to 800 nm. Accordingly, to provide a good fixing property, it is preferable that the toner should have a good absorbing property to rays of the near infrared region.

The polymeric substances typically used as the binder, which is the main component of the toner 1, generally have very low absorption properties with respect to light energy of the visible and near infrared regions, and colorants other than black colorants have acceptable absorption characteristics with respect to rays of the visible region but have poor absorption characteristics to rays of the near infrared region. Accordingly, a toner comprising such a binder resin and a non-black colorant in combination is, for all practical purpose, not capable of being melted by irradiation with the flash 3. For this reason, useful color toners for flash fixation processes have not been available in the past.

SUMMARY OF THE INVENTION

It is therefore a primary object of the present invention to provide a process for flash fixation using a color toner, which has heretofore been impossible.

In accordance with the present invention, this object is attained by a process for flash fixation, which is characterized by using a powdery developing toner comprising at least 80% by weight of a bisphenol A/epichlorohydrin type epoxy resin or a polyester resin as the binder resin, 1 to 10% by weight of a dye or pigment as the colorant and 1 to 10% by weight of an aminium compound represented by the following general formulae (I) or (II):

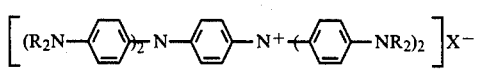

(I)

or

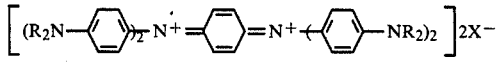

(II)

wherein R stands for a hydrogen atom or an alkyl group having 1 to 12 carbon atoms, and X stands for $SbF_6$ or $ClO_4$.

BRIEF DESCRIPTION OF THE DRAWINGS

FIGS. 1*a* and 1*b* are diagrams illustrating the state of fixation of the toner by a flash, in which FIG. 1*a* shows the state before the fixation and 1*b* shows the state after the fixation.

DESCRIPTION OF THE PREFERRED EMBODIMENTS

Figure 1A:
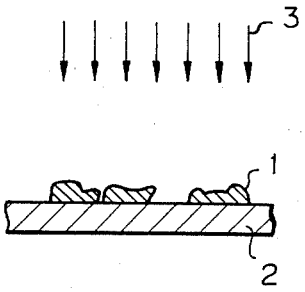
Figure 1B:
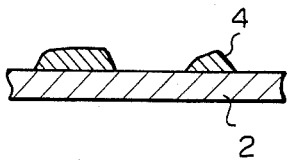
Figure 2:
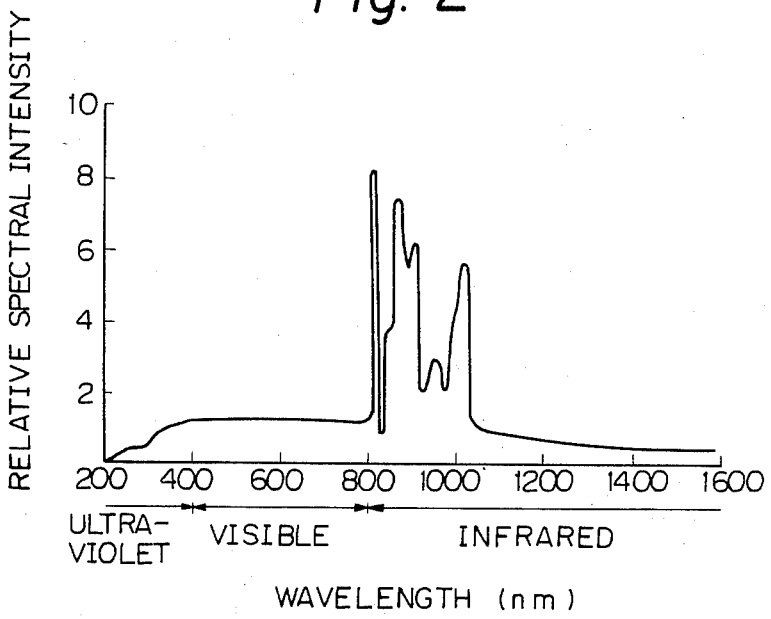
FIG. 2 is a diagram illustrating the spectral distribution of the flash of a xenon flash lamp.

Since the above-mentioned aminium compound has a very low absorption characteristic with respect to rays of the visible region and has its maximum absorption characteristic with respect to wavelength is present in the near infrared region of 800 to 1000 nm, a toner comprising such aminium compound is capable of absorbing great amounts of light energy of the near infrared region where the spectral intensity of a xenon flash lamp is high, even if the toner does not comprise a black colorant, and furthermore, since the hue given by the colorant is generally not affected by the aminium compound, if such aminium compound is used, there can be provided a color toner that can be applied in a practical sense in flash fixation processes using a xenon lamp.

Typical examples of the aminium compound used in the present invention are described below, and each compound provides practical benefits if it is incorporated in the toner in an amount of up to 10% by weight.

Bis(p-diethylaminophenyl)[N,N-bis(p-diethylaminophenyl)-p-aminophenyl]aminium hexafluoroantimonate of the following formula:

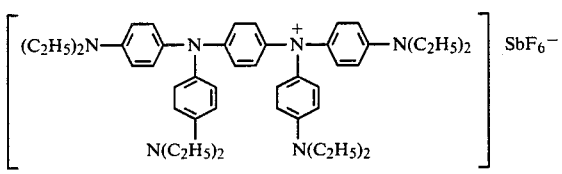

N,N,N',N'-tetrakis(p-diethylaminophenyl)-p-benzoquinone-bis(imonium hexafluoroantimonate) of the following formula:

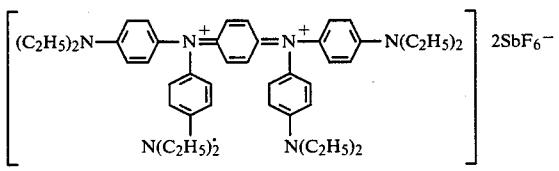

Preferred examples of the general compounds of formulae (I) and (II) set forth above are described as follows with reference to the specific substituents.

| Compound | R | X | Name |
|---|---|---|---|
| | | Formula (I) | |
| (a) | $CH_3$ | $SbF_6$ | bis(p-dimethylamino-phenyl)[N,N—bis(p-dimethyl-aminophenyl)-p-amino-phenyl]aminium hexafluoro-antimonate |
| (b) | n-$C_4H_9$ | $ClO_4$ | bis(p-di-n-butylamino-phenyl)[N,N—bis(p-di-n-butylaminophenyl)-p-amino-phenyl]aminium perchlorate |
| (c) | n-$C_3H_7$ | $ClO_4$ | bis(p-di-n-propylamino-phenyl)[N,N—bis(p-di-n-propylaminophenyl)-p-amino-phenyl]aminium perchlorate |
| | | Formula (II) | |
| (d) | n-$C_4H_9$ | $ClO_4$ | N,N,N',N'—tetrakis(p-di-n-butylaminophenyl)-p-benzo-quinone-bis(imomium perchlorate) |
| (e) | $C_8H_{17}$ | $SbF_6$ | N,N,N',N'—tetrakis(p-dioctylaminophenyl)-p-benzoquinone-bis(imomium hexafluoroantimonate) |
| (f) | $C_{12}H_{25}$ | $SbF_6$ | N,N,N',N'—tetrakis(p-didodecylaminophenyl)-p-benzoquinone-bis(imomium hexafluoroantimonate) |

In the process of the present invention, the aminium compound of the formula (I) or (II) is incorporated in the toner in an amount of 1 to 10% by weight, preferably 1 to 5% by weight, based on the total toner composition. If the amount of the compound of the formula (I) or (II) is smaller than 1% by weight, the light absorption efficiency is low, and even if the amount of the compound of the formula (I) or (II) is larger than 10% by weight, no substantial improvement of the effect is attained.

The bisphenol A/epichlorohydrin type epoxy resin used in the present invention has a molecular structure which is very stable against irradiation with flash light, and even under irradiation with strong infrared rays, the resin does not produce a bad smell or harmful gas.

Typical examples of the epoxy resin are commercially available as Epikote 1001, Epikote 1004, Epikote 1007 and Epikote 1009 supplied by Shell Chemical, Araldite 6071, Araldite 7071, Araldite 7072, Araldite 6084, Araldite 7097, Araldite 6097 and Araldite 6099 supplied by Ciba-Geigy, and Epiclon 1050, Epiclon 3050, Epiclon 4050 and Epiclon 7050 supplied by Dainippon Ink Kagaku Kogyo.

The bisphenol A/epichlorohydrin type resin preferably has a melting point of from 60° to 160° C., a weight average molecular weight of from 3,000 to 30,000 an epoxy equivalent of from 450 to 5,500 and contains up to 4% by weight of a monomeric bisphenol A glycidyl ether. If the melting point is lower than 60° C., the toner particles tend to adhere to one another, that is, to cause blocking. If the melting point is higher than 160° C., undesirable fixation on paper occurs. If the weight is average molecular weight lower than 3,000 or higher than 30,000, or if the epoxy equivalent is less than 450 or more than 5,500, the melting point will generally be outside the desired range.

The polyester resin has a molecular structure which is very stable against irradiation with flash light, and even under irradiation with near strong infrared rays, the resin does not produce a bad smell or harmful gas.

The polyester is prepared from a polyol such as a diol, a divalent carboxylic acid or a lower alkyl ester thereof, and a polyvalent carboxylic acid having a valency of at least 3, an acid anhydride thereof or a mixture thereof. Typical examples of the polyester resin are commercially avalable as KTR 1110, KTR 2150, KTR 2320, KTR 2150, ATR 2007 and ATR 2009 supplied by Kao Corporation.

The polyester resin preferably has a weight average molecular weight of from 2,000 to 20,000 and a melting point of from 60° to 140° C. If the melting point is lower than 60° C., the toner particles tend to adhere to one another and blocking is readily caused during the storage. If the melting point is higher than 140° C., a toner having a good flowability cannot be obtained and the fixing property is often degraded. The weight average molecular weight of a polyester resin having a preferred melting point is ordinarily in the range of from 2,000 to 20,000.

Quinacridone or rhodamine type red colorants, copper phthalocyanine or triphenylmethane type blue colorants and benzidine type yellow colorants may be used as the colorant.

A metal-containing dye, a fatty acid ester or an amino group-containing compound may be added as the charge control agent in the conventional manner according to need.

In the process of the present invention, it is preferred that a xenon flash lamp be used as the discharge tube for the flash fixation. The reason is that the xenon flash lamp flash has an especially high special intensity in the near infrared region of 800 to 1,000 nm. It is preferred that the voltage applied to the lamp be 1,000 to 2,500 V, the capacitor capacitance be 100 to 500 μF, and the flash energy ($Q=\frac{1}{2}CV^2$) be 100 to 1,000 J. Furthermore, it is preferred that the flash duration T, which is defined as the time from the point when the spectral output reaches $\frac{1}{3}$ of the peak value in the flash wave form to the point when the spectral output is restored to $\frac{1}{3}$ of the peak value, be 200 to 2,000 μsec. If the flash energy Q is smaller than 100 J, it sometimes happens that the toner is not sufficiently melted, and if the flash energy is larger than 1,000 J, the toner is explosively fixed and no good results are obtained. If the flash duration T is shorter than 200 μsec, the fixation is insufficient and if the flash duration T is longer than 2,000 μsec, the radiation energy is increased and no good results are obtained.

The toner used in the present invention can be prepared according to known processes. More specifically, the binder resin, the colorant and the aminium compound, optionally with the charge control agent therein may be kneaded, melted and uniformly dispersed by a compression kneader, a roll mill or an extruder, and the dispersed mixture may then be finely divided by a pulverizer or a jet mill, and the pulverized composition classified by an air classifier to obtain an intended toner.

According to the present invention, a color toner is provided which can be fixed by a flash fixation procedure using a xenon lamp in the electrophotographic process, and color printing is possible while adopting the most preferred fixation process.

The present invention will now be described in detail with reference to the following examples that by no means are intended to limit the scope of the invention.

EXAMPLE 1

A composition as shown in Table 1 was kneaded for 1 hour by a compression kneader heated at 100° C., and the kneaded composition was cooled and solidified and was then roughly pulverized by a pulverizer and finely divided by a jet mill. The obtained fine powder was classified by an air classifier to obtain a blue toner having a size of 5 to 20 μm.

TABLE 1

| Composition (% by weight) of Blue Toner of Present Invention | |
|---|---|
| Epoxy resin (Epiclon 4061 supplied by Dainippon Ink Kagaku Kogyo) | 95 |
| Copper phthalocyanine (Rionol Blue ES supplied by Toyo Ink) | 3 |
| Aminium compound, bis(p-di-n-butylaminophenyl)[N,N—bis-p-di-n-butylaminophenyl)-p-aminophenyl]aminium perchlorate | 2 |

A developer comprising 3% by weight of this toner and 97% by weight of iron powder (TSV 200 supplied by Nippon Teppun) as the carrier was prepared, and the fixing test was carried out using a laser printer (Model F-6715D supplied by Fujitsu) employing a xenon flash fixation system.

In the fixing zone, a capacitor having a capacitance of 160 μF was used, and the charge voltage was varied over the range of from 1,000 to 2,500 V and applied to a flash lamp.

The fixing property was evaluated in the following manner. An adhesive type (Scotch Mending Tape supplied by Sumitomo-3M) was lightly applied to the recording paper and a columnar block of iron having a diameter of 100 mm and a thickness of 20 mm was rolled on the tape at a certain speed in the circumferential direction to stick the tape closely to the recording paper. Then, the tape was peeled from the recording paper. The amount of the toner adhering to the tape was checked with the naked eye. When the toner did not adhere to the tape at all, it was judged that the fixation was complete.

As the result, it was found that if the voltage applied to the xenon flash lamp was 2050 V, complete fixation could be practically attained.

For comparison, a blue toner was prepared using the comparative composition shown in Table 2, in which the aminium compound was replaced by the binder resin, and the foregoing fixing test was carried out by using this toner. As the result, it was found that even if the applied voltage was maintained at a highest level, that is, 2500 V, the toner was not fixed at all, and when the fixing operation was repeated 10 times at 2500 V, the fixation ratio was about 50% and the toner could not be practically used.

TABLE 2

| Composition (% by weight) of Comparative Blue Toner | |
|---|---|
| Epoxy resin (Epiclon 4061 supplied by Dainippon Ink Kagaku Kogyo) | 97 |
| Copper phthalocyanine (Rionol Blue ES supplied by Toyo Ink) | 3 |

When the toner of Example 1 was compared with the above comparative toner comprising the same colorant with respect to the hue of the obtained print, the difference of the hue was very slight and there were no practical problems other than the inability of the comparative toner to be fixed. Accordingly, it was confirmed that when the above-mentioned aminium compound was added to the toner, the hue was not substantially changed but the fixing property was highly improved, and a practically effective color toner for xenon flash fixation processes was obtained.

EXAMPLE 2

A composition as shown in Table 3 was kneaded for 1 hour by a compression kneader heated at 100° C. and cooled and solidified and was then roughly pulverized by a pulverizer and finely divided by a jet mill. The obtained fine powder was classified by an air classifier to obtain a blue toner having a size of 5 to 20 μm.

TABLE 3

| Composition (% by weight) of Blue Toner of Present Invention | |
|---|---|
| Polyester resin (ATR 2009 supplied by Kao Corporation) | 95 |
| Copper phthalocyanine (Rionol Blue ES supplied by Toyo Ink) | 3 |
| Aminium compound, bis(p-di-n-butylamino-phenyl)[N,N—bis-p-di-n-butylaminophenyl)-p-aminophenyl]aminium perchlorate | 2 |

A developer comprising 3% by weight of this toner and 97% by weight of iron powder (TSV 200 supplied by Nippon Teppun) as the carrier was prepared, and the fixing test was carried out using a laser printing (Model F-6715D supplied by Fujitsu) employing a xenon flash fixation system.

In the fixing zone, a capacitor having a capacitance of 160 μF was used, and the charge voltage was varied over the range of from 1,000 to 2,500 V and applied to a flash lamp.

The fixing property was evaluated in the following manner. An adhesive tape (Scotch Mending Tape supplied by Sumitomo-3M) was lightly applied to the recording paper, and a columnar block of iron having a diameter of 100 mm and a thickness of 20 mm was rolled on the tape at a constant speed in the circumferential direction to stick the tape closely to the recording paper. Then, the tape was peeled from the recording paper and the quantity of the toner adhering to the tape was checked with the naked eye, and when the toner did not adhere to the tape at all, it was judged that the fixation was complete.

As the result, it was found that if the voltage applied to the xenon flash lamp was 2100 V, complete fixation could be practically attained.

For comparison, a blue toner was prepared using the comparative composition shown in Table 4, in which the aminium compound was replaced by the binder resin, and the foregoing fixing test was carried out using this toner. As the result, it was found that even if the applied voltage was maintained at a highest level, that is, 2500 V, the toner was not fixed at all, and when the fixing operation was repeated 10 times at 2500 V, the fixation ratio was about 50% and the toner could not be practically used.

TABLE 4

| Composition (% by weight) of Comparative Blue Toner | |
|---|---|
| Polyester resin (ATR 2009 supplied by Kao Corporation) | 97 |
| Copper phthalocyanine (Rionol Blue ES supplied by Toyo Ink) | 3 |

When the toner of Example 2 was compared with the above comparative toner comprising the same colorant with respect to the hue of the obtained print, the difference of the hue was very slight and there were no practical problems other than the inability of the comparative toner to be fixed. Accordingly, it was confirmed that when the above-mentioned aminium compound was added to the toner, the hue was not substantially changed but the fixing property was highly improved, and a practically effective color toner for xenon flash fixation processes was obtained.

EXAMPLE 3

In the same manner as described in Example 1, a composition as shown in Table 5 was kneaded and pulverized to obtain a red toner having a size of 5 to 20 μm.

TABLE 5

| Composition (% by weight) of Red Toner | |
|---|---|
| Epoxy resin (Epiclon 4061 supplied by Dainippon Ink Kagaku Kogyo) | 92 |
| Quinacridone pigment (Syncashar Red supplied by du Pont) | 5 |
| Aminium compound, bis(p-di-n-butylamino-phenyl)[N,N—bis(p-di-n-butylaminophenyl)-p-aminophenyl]aminium perchlorate | 3 |

In the same manner as described in Example 1, a developer was prepared using this toner and the fixing test was carried out to evaluate the fixing property. It was found that if the voltage applied to the xenon flash lamp was 2100 V, complete fixation could be practically attained.

For comparison, a red toner was prepared by using the comparative composition shown in Table 6, in which the aminium compound was replaced by the binder resin, and the fixing test was carried out by using this toner. As the result, it was found that even if the applied voltage was maintained at a highest level, that is, 2500 V, the toner was not fixed at all, and when the fixation operation was repeated 10 times, the fixing ratio was lower than 10% and the toner was hardly fixed.

TABLE 6

| Composition (% by weight) of Comparative Red Toner | |
|---|---|
| Epoxy resin (Epiclon 4061 supplied by Dainippon Ink kagaku Kogyo) | 95 |
| Quinacridone pigment (Syncashar Red supplied by du Pont) | 5 |

EXAMPLE 4

In the same manner as described in Example 1, a composition as shown in Table 7 was kneaded and pulverized to obtain a red toner having a size of 5 to 20 μm.

TABLE 7

| | |
|---|---|
| Polyester resin (ATR 2009 supplied by Kao Corporation) | 92 |
| Quinacridone pigment (Cyncashar Red supplied by du Pont) | 5 |
| Aminium compound, bis(p-di-n-butylamino-phenyl)[N,N—bis(p-di-n-butylaminophenyl)-p-aminophenyl]aminium perchlorate | 3 |

In the same manner as described in Example 1, a developer was prepared using this toner and the fixing test was carried out to evaluate the fixing property. It was found that when the voltage applied to the xenon flash lamp was 2200 V, complete fixation could be practically attained.

For comparison, a red toner was prepared by using a comparative composition as shown in Table 8, in which the aminium compound was replaced by the binder resin, and the fixing test was carried out by using this toner. As a result, it was found that even if the applied voltage was maintained at a highest level, that is, 2500 V, the toner was not fixed at all, and when the fixing operation was repeated 10 times at 2500 V, the toner was not fixed at all.

TABLE 8

| Composition (% by weight) of Comparative Red Toner | |
|---|---|
| Polyester resin (ATR 2009 supplied by Kao Corporation) | 95 |
| Quinacridone pigment (Syncashar Red supplied by du Pont) | 5 |

We claim:

1. An electrophotographic flash fixation process, which is characterized by using a powdery developing toner having improved light energy absorption properties comprising at least 80% by weight of a bisphenol A/epichlorohydrin type epoxy resin or a polyester resin as the binder resin, 1 to 10% by weight of a dye or pigment as the colorant and a light energy absorption improving quantity, in the range of from about 1 to 10% by weight of an aminium compound represented by the following general formula (I) or (II):

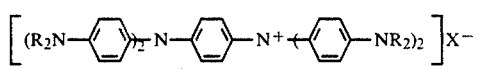

(I)

or

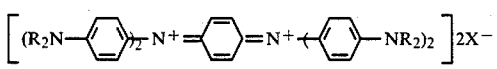

(II)

wherein R stands for a hydrogen atom or an alkyl group having 1 to 12 carbon atoms, and X stands for $SbF_6$ or $ClO_4$.

2. A process according to claim 1, wherein the powdery developing toner contains 1 to 5% by weight of the aminium compound.

3. A process according to claim 1, wherein the compound of the formula (I) is selected from bis(p-diethylaminophenyl)[N,N-bis(p-diethylaminophenyl)-p-amionophenyl]aminium hexafluoroantimonate, bis(p-dimethylaminophenyl)[N,N-bis(p-dimethylaminophenyl)-p-aminophenyl]aminium hexafluoroantimonate, bis(p-di-n-butylaminophenyl)[N,N-bis(p-di-n-butylaminophenyl)-p-aminophenyl]aminium perchlorate and bis(p-di-n-propylaminophenyl)[N,N-bis(p-di-n-propylaminophenyl)-p-aminophenyl]aminium perchlorate.

4. A process according to claim 1, wherein the compound of the formula (II) is selected from N,N,N',N'-tetrakis(p-diethylaminophenyl)-p-benzoquinone-bis-(imonium hexafluoroantimonate), N,N,N',N'-tetrakis(p-di-n-butylaminophenyl)-p-benzoquinone-bis(imonium perchlorate), N,N,N',N'-tetrakis(p-dioctylaminophenyl)-p-benzoquinone-bis(imonium hexafluoroantimonate) and N,N,N',N'-tetrakis(p-didodecylaminophenyl)-p-benzoquinone-bis(imonium hexafluoroantimonate).

5. A process according to claim 1, wherein the epoxy resin has a melting point of 60° to 160° C.

6. A process according to claim 1, wherein the epoxy resin has a weight average molecular weight of 3,000 to 30,000.

7. A process according to claim 1, wherein the epoxy resin has an epoxy equivalent of 450 to 5,500.

8. A process according to claim 1, wherein the polyester resin has a melting point of 60° to 140° C.

9. A process according to claim 1, wherein the polyester resin has a weight average molecular weight of 2,000 to 20,000.

10. A process according to claim 1, wherein the colorant is selected from a quinacridone type or rhodamine type red colorant, a copper phthalocyanine type or triphenylmethane type blue colorant and a benzidine type yellow colorant.

11. A process according to claim 1, wherein the fixation is performed by a flash of a xenon flash lamp.

12. A process according to claim 11, wherein the flash energy is 100 to 1,000 J.

13. A process according to claim 11, wherein the flash duration is 200 to 2,000 μsec.

14. A process according to claim 1, wherein the powdery developing toner contains a charge control agent.

15. A powdery developing toner for use in connection with an electrophotographic flash fixation process and having improved light energy absorption properties comprising at least 80% by weight of bisphenol A/epichlorohydrin type epoxy resin or a polyester resin as the binder resin, 1 to 10% by weight of a dye or pigment as the colorant and a light energy absorption improving quantity, in the range of from about 1 to 10% by weight of an aminium compound represented by the following general formula (I) or (II):

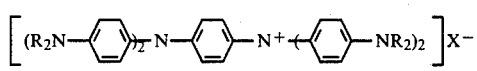

(I)

or

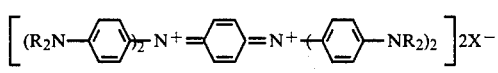

(II)

wherein R stands for a hydrogen atom or an alkyl group having 1 to 12 carbon atoms, and X stands for $SbF_6$ or $ClO_4$.

16. A toner as set forth in claim 15, wherein the aminium compound is present in an amount of from about 1 to 5% by weight.

17. A toner as set forth in claim 15, wherein the compound of the formula (I) is selected from bis(p-diethylaminophenyl)[N,N-bis(p-diethylaminophenyl)-p-aminophenyl]aminium hexafluoroantimonate, bis(p-dimethylaminophenyl)[N,N-bis(p-dimethylaminophenyl)-p-aminophenyl]aminium hexafluoroantimonate, bis(p-di-n-butylaminophenyl)(N,N-bis(p-di-n-butylaminophenyl)-p-aminophenyl]aminium perchlorate and bis(p-di-n-propylaminophenyl)[N,N-bis(p-di-n-propylaminophenyl)-p-aminophenyl]aminium perchlorate.

18. A toner as set forth in claim 15, wherein the compound for the formula (II) is selected from N,N,N',N'-tetrakis(p-diethylaminophenyl)-p-benzoquinone-bis-(imonium hexafluoroantimonate), N,N,N',N'-tetrakis(p-di-n-butylaminophenyl)-p-benzoquinone-bis(iminonium perchlorate), N,N,N',N'-tetrakis(p-dioctylaminophenyl)-p-benzoquinone-bis(imonium hexafluoroantimonate) and N,N,N',N'-tetrakis(p-didodecylaminophenyl)-p-benzoquinone-bis(imonium hexafluoroantimonate).

19. A toner as set forth in claim 15, wherein the epoxy resin has a melting point of 60° to 160° C.

20. A toner as set forth in claim 15, wherein the epoxy resin has a weight average molecular weight of 3,000 to 30,000.

21. A toner as set forth in claim 15, wherein the epoxy resin has an epoxy equivalent of 450 to 5,500.

22. A toner as set forth in claim 15, wherein the polyester resin has a melting point of 60° to 140° C.

23. A toner as set forth in claim 15, wherein the polyester resin has a weight average molecular weight of 2,000 to 20,000.

24. A toner as set forth in claim 15, wherein the colorant is selected from a quinacridone type or rhodamine type and colorant, a copper phthalocyanine type or triphenylmethane type blue colorant and a benzidine type yellow colorant.

25. A toner as set forth in claim 15 and further containing a charge control agent.

* * * * *

UNITED STATES PATENT AND TRADEMARK OFFICE

CERTIFICATE OF CORRECTION

PATENT NO. : 4,699,863

DATED : October 13, 1987

INVENTOR(S) : Nori Sawatari, Yasuo Yamagishi, Katsuji Ebisu, Yoshimichi Katagiri, Toshiaki Narusawa It is certified that error appears in the above-identified patent and that said Letters Patent is hereby corrected as shown below:

Column 4, line 45, after "30,000" insert --and--.

Column 8, line 41, "kagaku" should be --Kagaku--.

Column 10, line 63, "iminonium" should be --imonium--.

Column 12, line 6, "and" should be --red--.

Signed and Sealed this

Twenty-second Day of March, 1988

*Attest:*

*Attesting Officer*

DONALD J. QUIGG

*Commissioner of Patents and Trademarks*